United States Patent [19]

Reid

[11] 4,049,082

[45] Sept. 20, 1977

[54] STRUCTURAL MEMBER FOR A STRUCTURAL FRAME

[75] Inventor: Robert Reid, Mississauga, Canada

[73] Assignee: Daymond Limited, Mississauga, Canada

[21] Appl. No.: 639,054

[22] Filed: Dec. 9, 1975

[51] Int. Cl.[2] ..... E06C 7/10

[52] U.S. Cl. ..... 182/217; 29/150; 52/693; 52/696; 52/732; 72/367; 113/116 HH

[58] Field of Search ..... 182/217, 218, 219, 165–177, 182/228, 220; 52/693, 696, 729, 697, 753 J, 732, 731, 472, 528, 146, 152, 695; D54/7; 72/365; 29/150; 113/116 HH; 248/248; 403/331, 339

[56] References Cited

U.S. PATENT DOCUMENTS

| | | | |
|---|---|---|---|
| 800,055 | 9/1905 | Ayres | D54/7 |
| 910,192 | 1/1909 | Grouvelle | D54/7 |
| 1,479,262 | 1/1924 | Stegeman | 182/176 |
| 1,826,452 | 10/1931 | Carpenter | 52/465 |
| 3,332,197 | 7/1967 | Hinkle | 52/732 |

*Primary Examiner*—Reinaldo P. Machado

[57] ABSTRACT

A structural member for a structural frame comprises a substantially planar wall and two opposing irregular-shaped sidewalls integral with the planar wall. Each irregular-shaped sidewall has a corrugation. The member has two free ends where the portion adjacent each free end is flattened. The corrugated sidewalls are adapted to fold upon themselves when a force is applied to an area of the member. The flattened portion is adapted to be secured by fastening means to components of the structural frame. The width of the flattened portion is substantially the same as the nominal width of the member. The structural member has a neat appearance at its flattened portion.

9 Claims, 5 Drawing Figures

STRUCTURAL MEMBER FOR A STRUCTURAL FRAME

FIELD OF INVENTION

This invention relates to a structural member which is readily flattened for purposes of attachment to components of a structural frame. The width of the flattened portion remains substantially the same as the nominal width of the member.

BACKGROUND OF THE INVENTION

Structural members often found as supporting struts or the like on structural frames are of a cylindrical tubular shape where their free ends are flattened to facilitate attachment to various components of a structural frame to enhance its stability. Such structural members with their ends flattened give the appearance of an unfinished product where the flattened portions are much wider than the diameter of the tube. Due to the flattening of the ends of a cylindrical tubular member, there is a substantial upset in the material which can result in stress cracks forming along the edges of the flattened tube ends thereby weakening this flattened portion of the structural member.

It is a principal object of the invention to provide a structural member of a configuration such that when a portion thereof is flattened to facilitate attachment to components of a structural frame, the width of the flattened portion is substantially the same as the nominal width of the structural member.

It is another object of this invention to provide a structural member of malleable material of a configuration which permits flattening of a portion of the member without detracting from the structural strength of the flattened portion.

It is a further object of the invention to provide a structural member of the aforesaid type which is readily adapted for use as a strut on a ladder frame or used as a structural member on a ladder frame.

It is yet another object of the invention to provide a strut for an aluminum ladder frame which is readily adapted for attachment between a ladder rung or step and a ladder rail to support the feet of the ladder where the flattened ends of the strut provide a finished appearance.

BRIEF SUMMARY OF THE INVENTION

The structural member according to this invention can be used on structural frames, such as scaffolding, support structures, ladder frames and other types of frames, as a supporting strut for structurally reinforcing components of a structural frame or as extension members and the like in a structural frame. The structural member can be readily adapted for attachment to components of a structural frame by flattening a portion or portions of the member and bending the flattened portions if needed to the desired angle and attaching the member to components of a structural frame by suitable fastening means.

The structural member is of a cross-sectional configuration such that when flattened, the width of the flattened portion is substantially the same as the nominal width of the structural member. The flattened portion of the member can be readily located in cramped areas which will accommodate the nominal width of the member, whereas with the flattened portion of a cylindrical tube, the width of the flattened tube portion is substantially greater than the width of the tube so that it is difficult to locate the flattened tube in cramped areas.

In flattening portions of the structural member, the sidewalls are designed to fold upon themselves in a manner which is less likely to induce metal cracking in the sidewalls where the bending is taking place as compared to flattening a cylindrical tube. The resultant flattened accordion shape according to this invention therefore provides a stronger flattened portion than the normal flattened cylindrical tube.

The structural member comprises a substantially planar wall and two opposing irregular-shaped sidewalls which are integral with substantially parallel edges of the planar wall. Each of the irregular-shaped sidewalls has a corrugation therein which extends along the latch of the sidewall.

The structural member may also have two opposing substantially planar walls which lie in substantially parallel planes where the opposing irregular-shaped sidewalls interconnect the substantially planar walls at their substantially parallel edges to define a hollow structural member.

To facilitate securing of the member to components of a structural frame, selected portions of the member are flattened where the corrugation in each sidewall permits the sidewalls to fold upon themselves when a force is applied to an area of the member. The flattened portions are adapted to be secured by fastening means to components of a structural frame.

With the provision of two opposing substantially planar walls, the distance between the interior surfaces of these opposing planar walls in a flattened portion of the member, prior to securing the flattened portion to a component of the ladder frame, is determined by the thickness of the folded irregular-shaped sidewalls.

In a preferred embodiment of the invention, the structural member can be used as a supporting strut, extension member or the like on a ladder frame. Portions of the member may be flattened to facilitate attachment to components of a ladder frame where the member has a finished neat appearance in the area of the flattened portions.

DESCRIPTION OF THE DRAWINGS

These and other objects, advantages and features of the invention will become apparent in the following detailed description of the preferred embodiments according to this invention as shown in the drawings wherein.

DETAILED DESCRIPTION OF THE PREFERRED EMBODIMENTS

Figure 1:
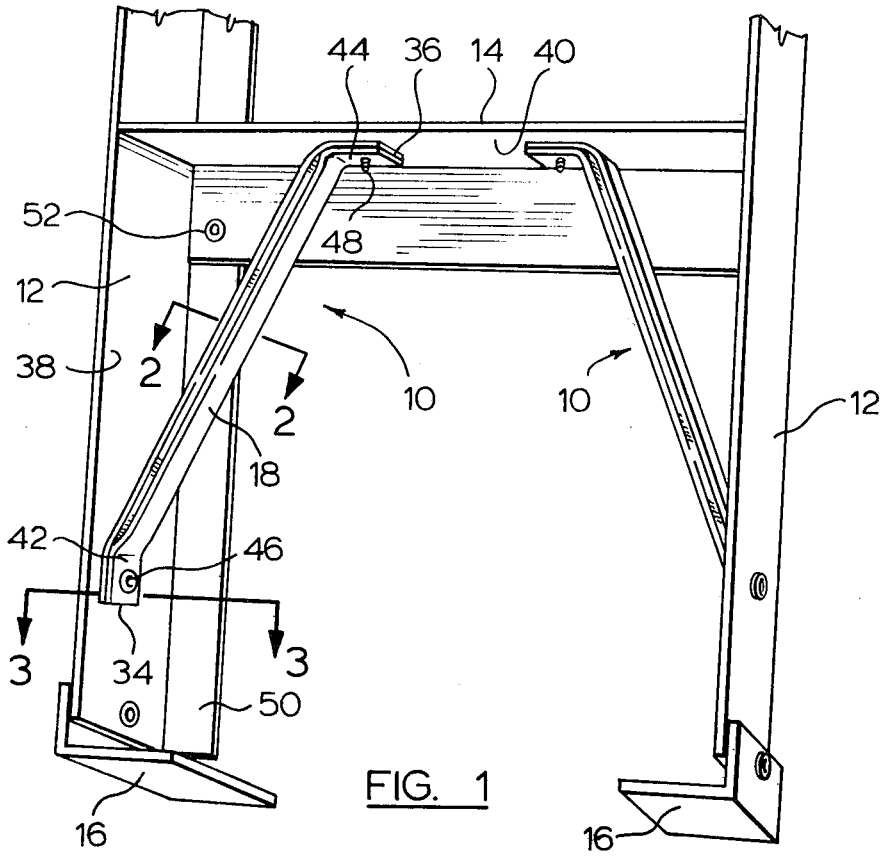
FIG. 1 is a partial elevation view showing the use of a structural member according to this invention as a supporting strut at the base of an aluminum step ladder frame.

Referring to FIG. 1, the bottom portion of an aluminum ladder frame is shown where two structural members of this invention are used as supporting struts 10 in reinforcing the feet of step ladder rails 12 relative to a step ladder crosspiece or rung 14. It is understood of course that in a preferred embodiment, the structural member as shown in FIG. 1 may be used as a strut for supporting a ladder rung or step relative to a ladder rail of extension ladders, platform ladders, step ladders and the like. In particular, it may be used on a type of ladder made according to the method defined in my U.S. Pat. No. 3,854,185. Further, it is understood that the structural member can be used on other types of structural frames for similar purpose or for use as other types of members in structural frames. Although the structural member is shown as being used on a ladder frame, it is understood that the member can also be used on scaffolding frames, construction support frames, light fixture support frames, metal cabinet construction and several other related fields of application.

The ladder frame has feet portions 16 attached to the rails 12 to provide frictional contact with the floor surface. Without the provision of strut 10, the ladder rails 12 at their base tend to bend inwardly or outwardly relative to crosspiece 14 when a load is applied to the ladder frame. The struts 10 therefore reinforce the cantilevered portions of rails 12 against inward and outward movement.

Figure 2:
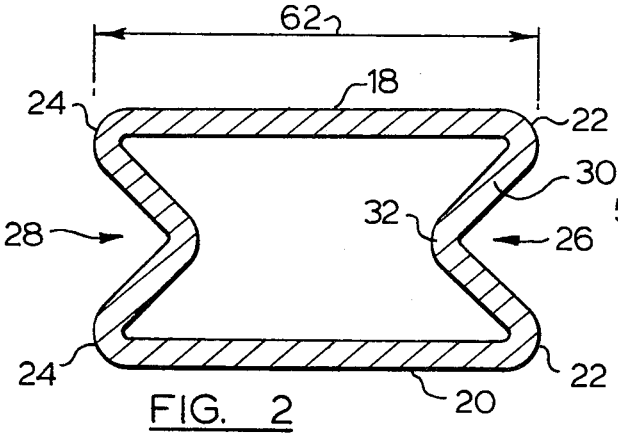
FIG. 2 is a cross section of the supporting strut taken along the lines 2—2 of FIG. 1.

The substantially planar walls 18 and 20 lie in substantially parallel planes as shown in FIG. 2. The substantially parallel edges 22 and 24 of planar walls 18 and 20 are interconnected by irregular-shaped sidewalls 26 and 28. The irregular-shaped sidewalls are corrugated in the manner shown to provide a substantially U- or V-shaped indentation which constitutes a pleat or flute in the sidewalls. The sidewalls are therefore essentially made up of inwardly extending leg portions 30 which meet in the general area designated 32.

The strut 10 has free ends 34 and 36. To facilitate securing of the strut 10 to the inner surface 38 of rail 12 and inner surface 40 of crosspiece 14, the portion of the strut adjacent the free ends are flattened to provide flattened portions 42 and 44. The flattened portions 42 and 44 are bent at an angle to the longitudinal axis of strut 10 to abut the flat surfaces 38 and 40. Pop rivets 46 and 48 or other suitable fastening means such as self-tapping screws are used to secure the flattened portion 42 and 44 to rail 12 and crosspiece 14. It should be noted that crosspiece 14 is secured to lip 50 by rivet 52.

The section of the strut 10 as shown in FIG. 2 has an inherent resistance to twist so that with the flattened portions 42 and 46 abutting flat surfaces of the rail and crosspiece, torsional movement of the rail relative to the crosspiece is resisted by the strut 10. As mentioned, the strut 10 also reinforces the cantilevered portion of the rail 12 which is beneath the crosspiece 14 to prevent it from bending inwardly and outwardly relative to the crosspiece when a load is applied to the ladder frame.

Figure 3:
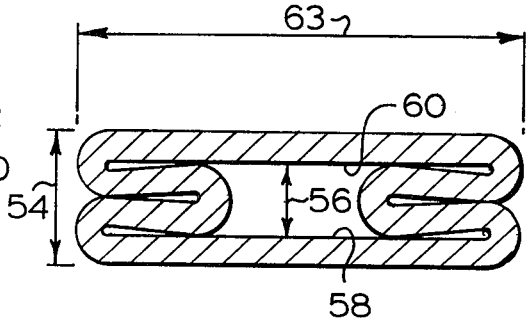
FIG. 3 is a section taken along the lines 3—3 of FIG. 1.

In making the flattened portions 42 and 44, a force is applied by way of a machine press, vice, hammer blow or the like adjacent the free ends 34 and 36 in a manner so as to move parallel faces 18 and 20 in a direction towards each other as corrugated sides 26 and 28 fold upon themselves to provide a section of the type shown in FIG. 3. During the folding of sidewalls 26 and 28, the leg portions 30 hinge about edges 22 and 24 and area 32 of the section to fold towards themselves. There is therefore some stretching of the metal about edges 22 and 24 and area 32 as the legs fold upon each other. However, the degree of stretching is not sufficient to induce metal cracking in the metal. On the other hand, in flattening a cylindrical tube, the stretching of the metal along the resultant edges is substantially greater so that metal cracking is likely to happen. Depending upon the magnitude of the force exerted, the section may be flattened to the extent shown in FIG. 3 where the external thickness 54 of the flattened portion is determined by the thickness of the folded legs 30 of the corrugated sides. The thickness 56 of the folded legs is the distance between the interior surfaces 58 and 60 of the section which is equal to approximately twice the thickness of the sidewall 28. This thickness 56 may of course decrease somewhat in the vicinity where a pop rivet 46 or 48 is applied in securing the flattened portions to components of ladder frame.

As shown in FIG. 3, the width 63 of the flattened portion is substantially the same as the nominal width 62 of the unflattened section shown in FIG. 2.

The configuration of the member according to this invention permits flattening of the member anywhere along its length in a manner to provide a flattened portion which is of substantially the same width as the nominal width of the strut and therefore provide a finished appearance.

The strength of the flattened portion is not hindered by the folding of corrugated sidewalls 26 and 28 since the legs 30 of the sidewalls hinge about edges 22 and 24 and area 32 so that the metal is not substantially upset. Stress-cracking is therefore not induced in the sidewalls of the member made of a malleable material, for example, an aluminum alloy commonly used in the aluminum ladder trade, malleable grades of steel and the like.

Figure 4:
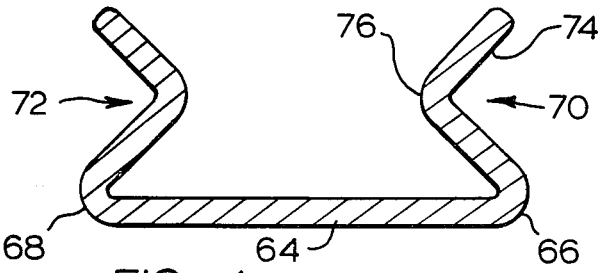
FIG. 4 shows a cross section of an alternate preferred shape of a structural member according to this invention.
Figure 5:
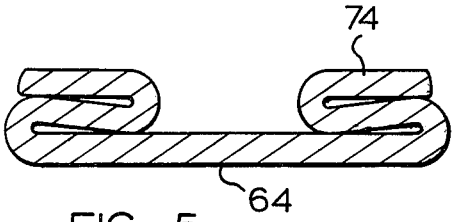
FIG. 5 shows the alternate preferred embodiment of FIG. 4 with the section flattened.

An alternative preferred embodiment of a cross-sectional shape for the structural member of the invention is shown in the sections of FIGS. 4 and 5 where there is provided a substantially planar wall 64 having integrally connected thereto at its parallel edges 66 and 68, upstanding corrugated sidewalls 70 and 72. The shape of the corrugated sidewalls 70 and 72 is substantially the same as that shown in FIG. 2. The legs 74 of the sidewalls are inwardly directed and meet in the area generally designated 76. When a portion of a strut of the type of FIG. 4 is flattened, the section takes on a shape a shown in FIG. 5 where the legs 74 are folded about edges 66 and 68 and the general area 76. The thickness of the fold of corrugated sidewalls 70,72 is approimately twice the thickness of the sidewall. The flattened portion is readily affixed to component of the ladder frame by use of pop rivets, screws and the like which extend through planar wall 64.

The strut as shown is used on the back leg portion of a step ladder. It is understood, however, that the strut 10 can be used to reinforce the cantilevered portion of the base of a ladder rail relative to a ladder rung or step. The strut 10 may also be used as a structural member in the supporting of paint pail platforms and other types of platforms on aluminum step ladders, extension ladders, platform ladders, and the like where portions of the structural member may be flattened to facilitate attachment of the member to components of a ladder frame. As previously mentioned, the structural member is readily used in a similar manner on other types of structural frames of the aforementioned type.

Although various preferred embodiments of the invention have been described herein in detail, it will be understood by those skilled in the art that variations may be made thereto without departing from the spirit of the invention or the scope of the appended claims.

The embodiments of the invention in which an exclusive property or priviledge is claimed are defined as follows:

1. In a ladder frame, a structural member of malleable metal comprising a substantially planar wall and two opposing irregular-shaped sidewalls which are integral with substantially parallel edges of said substantially planar wall, each of said irregular-shaped sidewalls having a corrugation therein which extends along the length of each sidewall, said member having two free ends, said corrugation adapting each sidewall to fold upon itself when a force is applied to an area of said member to provide a flattened portion on said member, the flattened portion being adapted to be secured by fastening means to a component of said ladder frame, the width of the flattened portion being substantially the same as the nominal width of said member.

2. In a ladder frame of claim 1, said structural member having two opposing substantially planar walls which lie in substantially parallel planes, said two opposing irregular-shaped sidewalls interconnecting said substantially planar walls at their substantially parallel edges to define a hollow structural member, said corrugation adapting each sidewall to fold upon itself when a force is applied to an area of the structural member so that said two opposing substantially planar walls move towards each other to provide a flattened portion, the distance between interior surfaces of said two opposing planar walls in a flattened portion prior to securing the flattened portion to a component of said ladder frame being determined by the thickness of the folded irregular-shaped sidewalls.

3. In a ladder frame of claim 1, the portion adjacent each of said two free ends being flattened to provide raid flattened portions.

4. In a ladder frame of claim 3, said structural member being a strut for structurally reinforcing components of said ladder frame, the flattened portions of said strut being secured to components of said ladder frame.

5. In a ladder frame of claim 2, the portion adjacent each of said free ends being flattened to provide raid flattened portions.

6. In a ladder frame of claim 5, said structural member being a strut for structurally reinforcing components of said ladder frame, the flattened portions of said strut being secured to components of said ladder frame.

7. In a ladder frame of claim 6, said irregular-shaped sidewalls having an indented portion of essentially V-shape extending along the length of said irregular-shaped sidewall.

8. In a ladder frame of claim 6, each flattened portion having a perforation to facilitate securing of said strut by a fastening means.

9. In a ladder frame of claim 6, said strut being secured at one of said flattened portions to an underside surface of an aluminum ladder rung and at the other of said flattened portions to an inner surface of an aluminum ladder rail, said strut being formed from an aluminum alloy.

* * * * *